US009604816B2

(12) United States Patent
Ersurmeli et al.

(10) Patent No.: US 9,604,816 B2
(45) Date of Patent: Mar. 28, 2017

(54) BOBBIN HOLDER ADAPTER

(71) Applicant: ORNEK MAKINA SANAYI VE TICARET ANONIM SIRKETI, Gaziantep (TR)

(72) Inventors: Orhan Ersurmeli, Gaziantep (TR); Bahattin Dabaniyasti, Gaziantep (TR); Sadettin Kapucu, Gaziantep (TR)

(73) Assignee: ORNEK MAKINA SANAYI VE TICARET ANONIM SIRKETI, Gaziantep (TR)

( * ) Notice: Subject to any disclaimer, the term of this patent is extended or adjusted under 35 U.S.C. 154(b) by 0 days.

(21) Appl. No.: 15/016,542

(22) Filed: Feb. 5, 2016

(65) Prior Publication Data

US 2016/0229657 A1 Aug. 11, 2016

(30) Foreign Application Priority Data

Feb. 10, 2015 (TR) ..... a 2015 12173

(51) Int. Cl.

| | |
|---|---|
| ***B65H 49/16*** | (2006.01) |
| ***B65H 49/06*** | (2006.01) |
| ***B65H 67/02*** | (2006.01) |
| ***D02H 1/00*** | (2006.01) |

(52) U.S. Cl.

CPC ..... *B65H 49/16* (2013.01); *B65H 49/06* (2013.01); *B65H 67/02* (2013.01); *D02H 1/00* (2013.01)

(58) Field of Classification Search

CPC ..... B65H 49/06; B65H 49/16; B65H 67/02; D02H 1/00

See application file for complete search history.

(56) References Cited

U.S. PATENT DOCUMENTS

| | | | | |
|---|---|---|---|---|
| 4,880,184 | A * | 11/1989 | Crow | B65H 49/06 242/130 |
| 7,866,595 | B2 * | 1/2011 | Chadwick | B65H 49/16 242/131 |
| 7,971,822 | B1 | 7/2011 | Crow | |

* cited by examiner

*Primary Examiner* — William E Dondero

(74) *Attorney, Agent, or Firm* — Egbert Law Offices, PLLC

(57) ABSTRACT

A bobbin holder adapter facilitates replacing bobbins in a yarn feeding system called a creel, and which is formed by bearing of a constant lower table and a movable upper table on a central shaft. Further, a motion restriction component is positioned on the upper table for restricting the motion of the upper table around the central shaft bearing the upper table and for stopping the adapter at the desired point, a motion restriction housing is formed on the lower table for enabling movement of the motion restriction component, a locking ball is provided for keeping the adapter in the optimum position for unreeling yarn, a locking spring is positioned on the upper table for applying force on the locking ball, and a locking housing is formed on the lower table, on which the locking ball makes pressure as a result of the force applied by the locking spring.

3 Claims, 4 Drawing Sheets

BOBBIN HOLDER ADAPTER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The invention relates to an adapter in textile sector enabling attachment of bobbins to creels.

The invention particularly relates to a bobbin holder adapter which facilitates replacing bobbins in a yarn feeding system called creel by means of its rotating structure and lock mechanism.

2. Description of Related Art Including Information Disclosed Under 37 CFR 1.97 and 37 CFR 1.98.

Production of woven textile products requires great numbers of yarns. These yarns are drawn from yarn bobbins placed within a yarn hanger. When a yarn bobbin is empty, it needs to be replaced with a new yarn bobbin. For this purpose, empty yarn bobbins are required to be taken out of the yarn bobbin holder and a new yarn bobbin is placed to the yarn bobbin holder.

Bobbin holders are indispensible and fundamental functional components of machines used in the textile sector. These bobbin holders are designed to facilitate attachment of standard bobbin types for yarns, braids, or cords onto the creel rails of heat treatment machines (yarn fixing machines), spinning machines etc., and they are connected to the machines and creels via adapters.

In the prior art, there are various kinds of adapters connecting bobbin holders suitable for various yarn bobbins to creels. Some of these are adapters positioned fixedly on a mounting surface. Fixed bobbin adapters have a structure that requires more labour during bobbin replacement and they are not ergonomic.

In the known status of the art, rotating bobbin adapters are designed in order to perform the bobbin replacement operation in an easier manner. A worker can perform the replacement operation in a simpler and easier manner by means of rotating the bobbin holder adapter into a more convenient position. However, the worker is required to use both hands for this rotating operation. Moreover, following bobbin replacement, while bringing the bobbin holder back into operating position, there is a risk of not being able to bring the bobbin adapter back to the operating position precisely.

In a patent research made about the subject, some applications are encountered in the prior art. One of these applications is the American patent application U.S. Pat. No. 4,880,184. The related application discloses a bobbin holder support. In the related bobbin holder support, the lock mechanism is required to be opened by manual drive in order to be able to replace the idle bobbin. In this case, the user may be required to use both hands. Moreover, the lock is required to be checked manually to make sure that the locking operation is complete. All these operations cause loss of time during both placement and removal of yarn bobbins.

Another application is the American patent application U.S. Pat. No. 7,971,822. The invention relates to a bobbin holder comprising a support profile. In said application, automatic locking and releasing components are connected onto a rotating cylinder fixedly via round-head screws and nuts. However, the rounded heads of the components that are fixed by screws and nuts rub against the fixed cylinder surface and cause abrasion. As a result, undesired gaps, vibration, and bending occur. Therefore, the parts may require replacement and/or deviation of the bobbin from the desired position may not be avoided. In addition to these, the locking force cannot be adjusted in desired values in the prior art systems.

As a result, need has occurred for improvement in the relevant technical field due to the above said drawbacks and shortcomings.

BRIEF SUMMARY OF THE INVENTION

The present invention relates to a bobbin holder adapter, formed with the inspiration from the prior art situations, and developed with the purpose of solving said drawbacks and bringing some other advantages.

The main purpose of the mechanism according to the present invention is to make improvements for solving the problems encountered in the prior art embodiments.

The purpose of the invention is to facilitate bobbin replacement via its rotating structure.

The purpose of the invention is to reduce the amount of force required for rotating the bobbin holder adapter via the lock mechanism found in its structure. In this way, operating performance would be improved by means of enabling a worker to perform the operation with one hand.

The purpose of the invention is to enable keeping the bobbin stable in its operating position, while the newly replaced yarn bobbin is brought to the level of operating position via the spring fixing mechanism it comprises.

The purpose of the invention is to adjust the locking spring pressure force via the spring pressure adjustment screw.

A purpose of the invention is to eliminate failure due to reasons like abrasion.

A purpose of the invention is to provide a bobbin holder adapter ensuring a long expected life.

In order to achieve above said purposes, the invention is a bobbin holder adapter which facilitates replacing bobbins in a yarn feeding system called creel, and which is formed by bearing of a constant lower table and a movable upper table on a central shaft, and it is characterized in that; it comprises:

- a motion restriction component positioned on the upper table for restricting the motion of the upper table around the central shaft bearing the upper table and for stopping the adapter at the desired point,
- a motion restriction housing formed on the lower table for enabling movement of said motion restriction component,
- a locking ball for keeping the adapter in the optimum position for unreeling yarn, a locking spring positioned on the upper table for applying force on said locking ball, a locking housing formed on the lower table, on which the locking ball makes pressure as a result of the force applied by said locking spring.

The structural and characteristic features of the invention and all of its advantages shall be understood better with the figures and the detailed description given below in reference to the figures, and therefore, the assessment should be made by taking into account the said figures and detailed explanations.

BRIEF DESCRIPTION OF THE SEVERAL VIEWS OF THE DRAWINGS

Drawings do not have to be scaled and details not necessary for understanding the present invention may be neglected. Moreover, components which are at least widely equal or which have at least widely equal functions are shown with the same number.

DESCRIPTION OF PARTS REFERENCES

Figure 1:
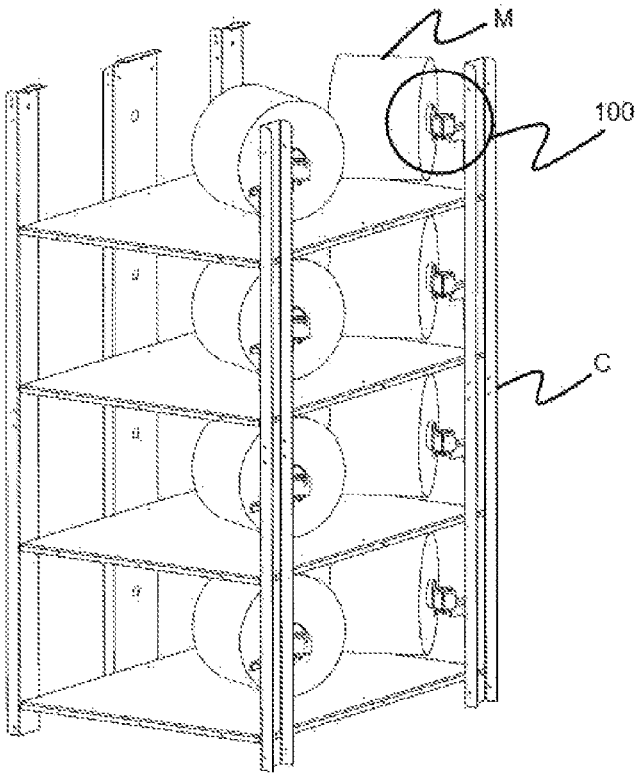
FIG. 1: Is a representative view of the bobbin holder adapter on the creel.

1. Mounting surface
2. Bearer shaft
3. Compression shaft
4. Mounting component
5. Bearer shaft fixing nut
10. Lower table
11. Motion restriction housing
12. Motion restriction component
13. Lower table fixing screw
20. Upper table
21. Locking ball housing
22. Locking ball
23. Locking spring
24. Spring pressure adjustment screw
30. Central shaft
35. Fixing nut
40. Fixing washer
45. Fixing screw
100. Bobbin holder adapter
M. Bobbin
C. Creel

DETAILED DESCRIPTION OF THE INVENTION

In this detailed description, the bobbin holder adapter (100) which facilitates replacing bobbins (M) in a yarn feeding system called creel (C) is only disclosed for better understanding of the subject.

FIG. 1 gives a representative view of the bobbin holder adapter (100) according to the invention on a creel (C). The connection of the bobbin holder adapter (100) on the creel (C) is made by means of a mounting surface (1), to which one of the main components of the bobbin holder adapter (100), a lower table (10) is attached via a fixing nut (35).

Figure 2:
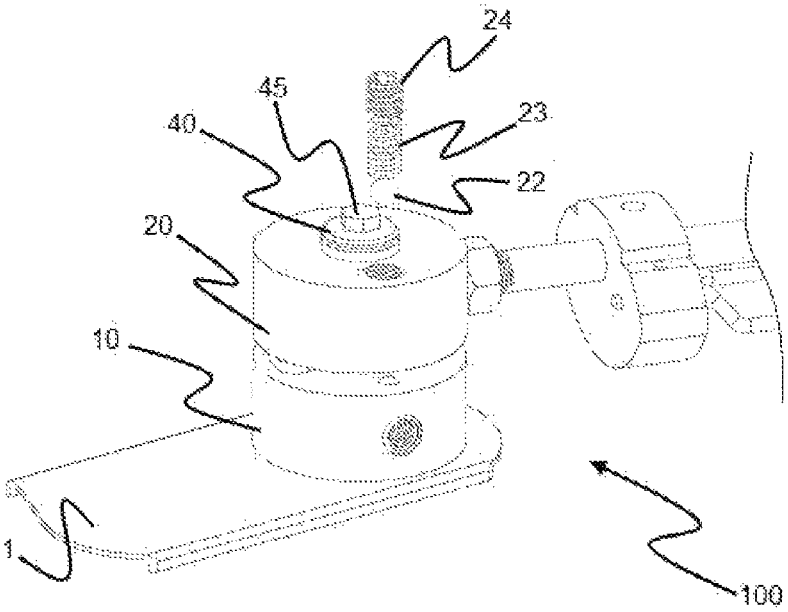
FIG. 2: Is a general perspective view of the bobbin holder adapter.
Figure 5:
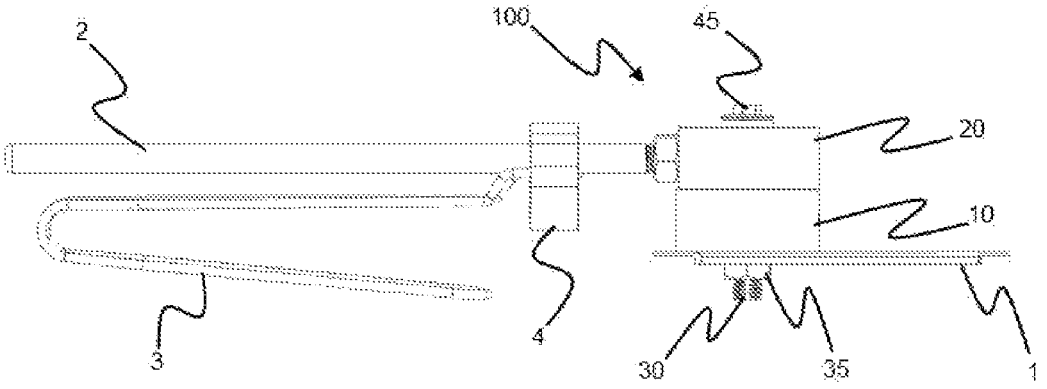
FIG. 5: Is a side view of the bobbin holder adapter.
Figure 6:
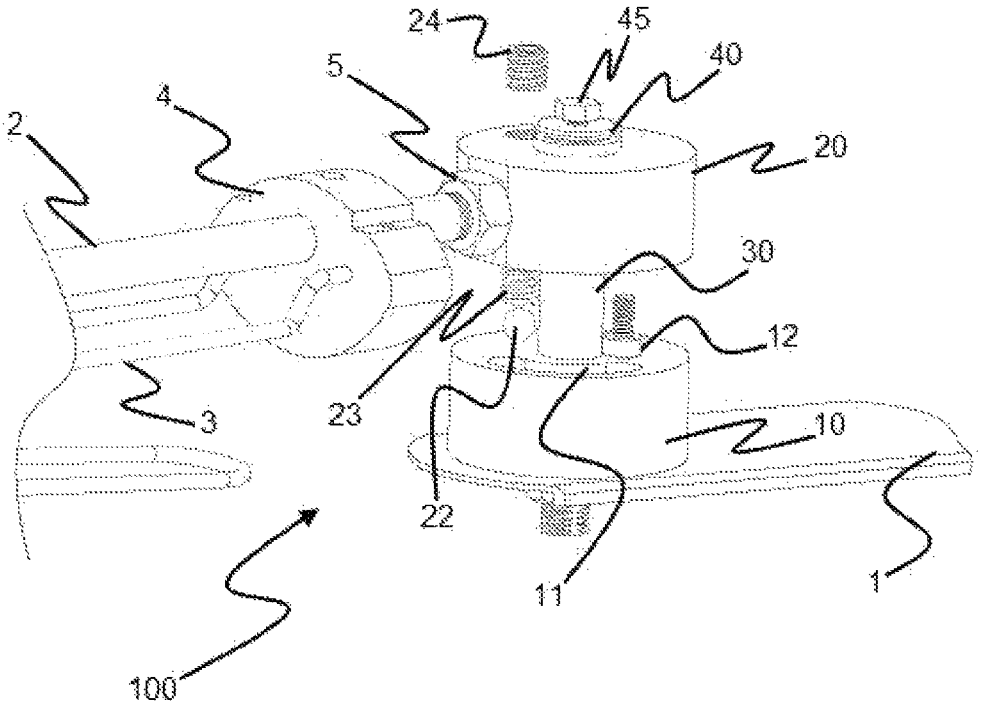
FIG. 6: Is a perspective rear view of the bobbin holder adapter.
Figure 7:
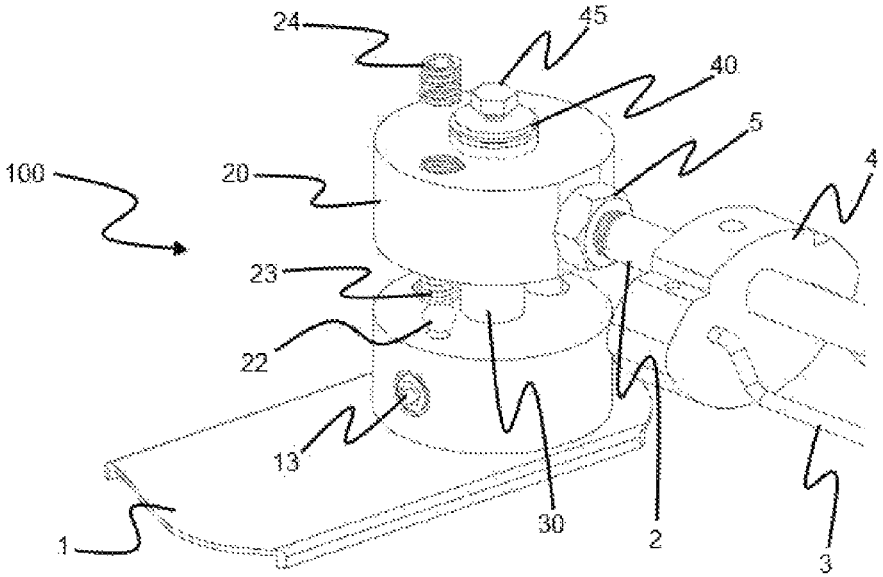
FIG. 7: Is a perspective rear view of the bobbin holder adapter from a different angle.

FIG. 2 shows the general perspective view of the bobbin holder adapter (100), while FIGS. 5, 6, and 7 shows the perspective view from different angles. Accordingly, the bobbin holder adapter (100) is formed by means of bearing of the lower table (10) forming the main structure and stable part of the system and the upper table (20) forming the movable part of the system on a central shaft (30).

The lower table (10) is fixed to the central shaft (30) via a lower table fixing screw (13). The upper table (20) is connected to the central shaft (30) via a fixing washer (40) and a fixing screw (45).

The bobbin (M) is attached to the bearer shaft (2) that is connected to the bobbin holder adapter (100) via a bearer shaft fixing nut (5), and the bearer shaft (2) is fixed by means of a clamping spring (3). The clamping spring (3) is connected to a mounting component (4) and the same mounting component (4) is connected to the bearer shaft (2).

Figure 8:
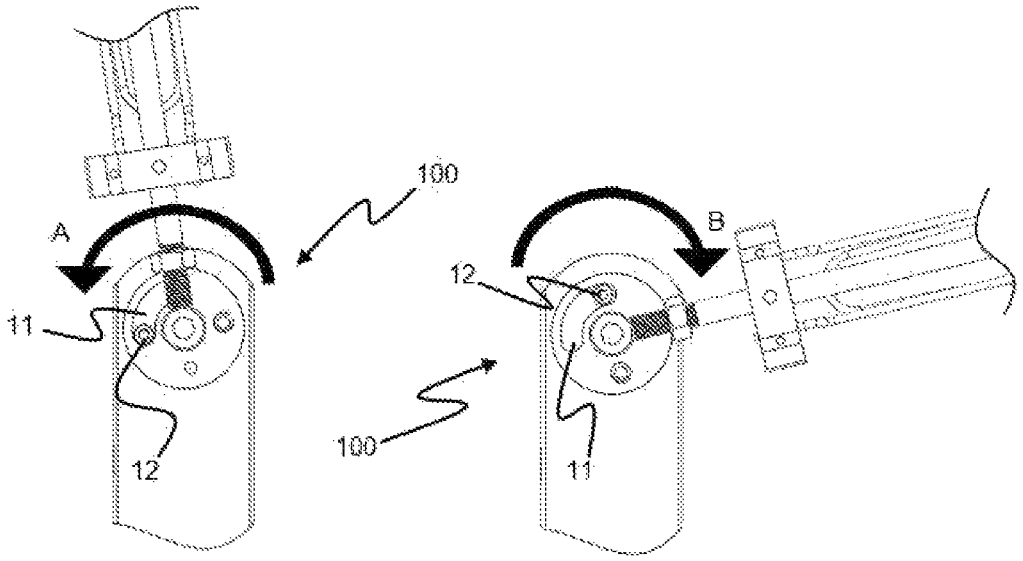
FIG. 8: Is a representative top view of the movement of the bobbin holder adapter in A and B directions.

When a full bobbin (M) is attached to the bobbin holder adapter (100) and brought to operating position or retracted to replace an empty bobbin (M), the upper table (20) makes a free rotational motion around the central shaft (30) bearing the upper table. In order to restrict this motion of the upper table (20) and stop the adapter at the desired point, a motion restriction component (12) positioned on the upper table (20) is moved within the motion restriction housing (11) opened on the lower table (10). FIG. 8 shows a representative top view of the movement of the bobbin holder adapter (100) in A and B directions. The angular movements of the upper table (20) in A and B directions is stopped by means of the motion restriction component (12) leaning against the end points of the motion restriction housing (11). In this way, further movement of the bobbin holder adapter (100) in each direction is restricted and the movement in both directions are taken under control.

Figure 3:
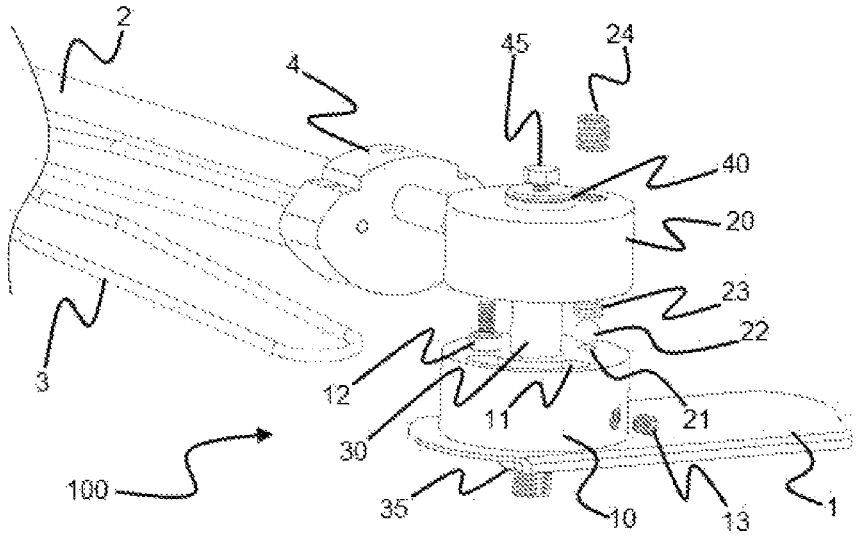
FIG. 3: Is a detailed view of the parts forming the bobbin holder adapter.
Figure 4:
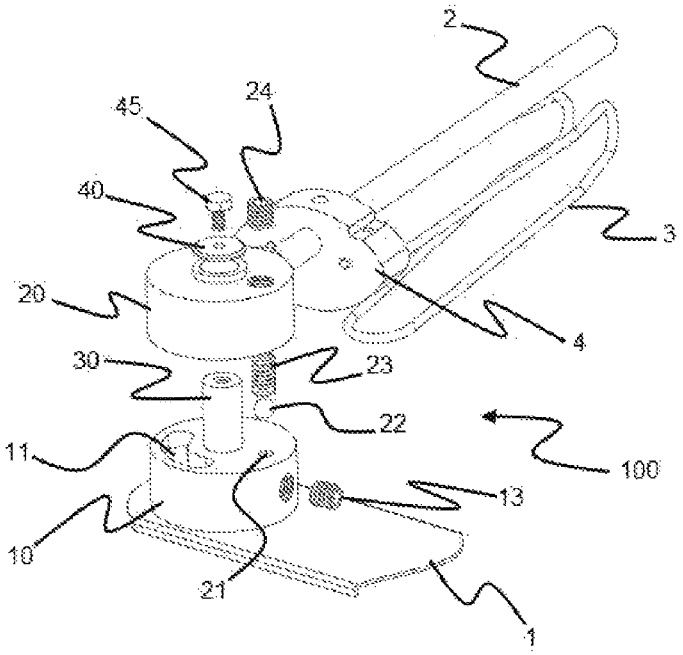
FIG. 4: Is the mounted/demounted views of the parts forming the bobbin holder adapter.

FIG. 3 shows the detailed view of the parts forming the bobbin holder adapter (100), and FIG. 4 shows the mounted/demounted view of these parts. In order to keep the bobbin holder adapter (100) in the optimum position for unreeling yarn, an adapter locking system formed of a locking ball (22) and a locking spring (23) is used. Said locking system is actuated by the locking ball (22) entering into the locking ball housing (21) found on the lower table (10). When a full bobbin (M) is attached and the bobbin holder adapter (100) is moved towards direction B, the upper table (20) starts to rotate around the central shaft (30) and when the locking ball (22) corresponds to the locking ball housing (21), the locking spring (23) pushes the locking ball (22) into the locking housing (21). In this way, the bobbin holder adapter (100) is locked at this point and enables holding the bobbin (M) at an optimum position for unreeling yarn. The locking spring (23) is kept constant in a housing found on the upper table (20) via a spring pressure adjustment screw (24). The function of the spring pressure adjustment screw (24) is to make the force applied by the locking spring (23) onto the locking ball (22) during the locking operation adjustable. Besides, the pressure of the locking spring (23) can be increased or decreased according to the weight of the bobbin (M) worked with.

When the bobbin holder adapter (100) is retracted in direction A for the purpose of replacing an empty bobbin (M), the locking ball (22) pushes the locking spring (23) in the opposite direction and thus it is freed from the locking housing (21). During this movement, the motion restriction component (12) found in the motion restriction housing (11) starts moving in direction A and after reaching the end point, it stops the motion of the bobbin holder adapter (100).

With the present invention, replacement of bobbins (M) is made easier with the rotating structure of the invention, and the amount of force required for rotating the bobbin holder adapter (100) is also reduced with the lock mechanism found in its structure. In this way, operating performance is improved by means of enabling a worker to perform the operation with one hand. Moreover, abrasion is also prevented, since the locking ball (22) would make a rolling motion on the lower table (10).

We claim:

1. A bobbin holder adapter which facilitates replacing bobbins in a yarn feeding system called a creel, and which is formed by bearing of a constant lower table and a movable upper table on a central shaft, and it is characterized in that the bobbin holder adapter comprises:

a motion restriction component positioned on the upper table for restricting the motion of the upper table around the central shaft bearing the upper table and for stopping the adapter at the desired point;

a motion restriction housing formed on the lower table for enabling movement of said motion restriction component;

a locking ball for keeping the adapter in the optimum position for unreeling yarn;

a locking spring positioned on the upper table for applying force on said locking ball; and a locking housing formed on the lower table, on which the locking ball makes pressure as a result of the force applied by said locking spring.

2. The bobbin holder adapter according to claim 1, characterized in that the bobbin holder adapter comprises: a spring pressure adjustment screw which adjusts the pressure applied on the locking ball by the locking spring, while keeping the locking spring constant at the upper table.

3. The bobbin holder adapter according to claim 1, characterized in that the bobbin holder adapter comprises: a fixing washer and a fixing screw connecting the upper table to the central shaft.

* * * * *